US007007320B2

(12) United States Patent
Ming-Hwa

(10) Patent No.: US 7,007,320 B2
(45) Date of Patent: Mar. 7, 2006

(54) STAND-UP BEDSIDE HOISTING APPARATUS

(75) Inventor: Shou Ming-Hwa, Hsin Tien (TW)

(73) Assignee: Dynamic Healthtech Inc, Taipei Hsien (TW)

( * ) Notice: Subject to any disclaimer, the term of this patent is extended or adjusted under 35 U.S.C. 154(b) by 943 days.

(21) Appl. No.: 09/976,231

(22) Filed: Oct. 11, 2001

(65) Prior Publication Data

US 2005/0006631 A1 Jan. 13, 2005

(51) Int. Cl.
*A61G 7/14* (2006.01)

(52) U.S. Cl. ..... 5/86.1; 5/81.1 R

(58) Field of Classification Search ..... 5/86.1, 5/81.1 R, 83.1, 85.1, 87.1, 89.1
See application file for complete search history.

(56) References Cited

U.S. PATENT DOCUMENTS 686,425 A * 11/1901 Sommerfeld ..... 5/86.1
3,252,704 A * 5/1966 Wilson ..... 482/68
3,659,594 A * 5/1972 Schwab ..... 606/237
3,877,421 A * 4/1975 Brown ..... 601/23
5,560,054 A * 10/1996 Simon ..... 5/86.1
6,260,218 B1 * 7/2001 Tsuga ..... 5/86.1

* cited by examiner

*Primary Examiner*—Alexander Grosz
(74) *Attorney, Agent, or Firm*—W. Wayne Liauh

(57) ABSTRACT

A stand-up bedside hoisting apparatus includes a base; three legs fixedly connected an inner ends to the base to stably support the entire hoisting apparatus; a pivoted-arm mechanism including a lower rotary shaft that is rotatable relative to the base within a safe angular range, and an upper suspension arm that can be turned up and down relative to the rotary shaft; and a hanger pivotally connected to a front end of the suspension arm for holding a hoisting carriage to carry and move a patient. The hoisting apparatus may be easily and conveniently erected to stand up at one side of a sickbed without the need of being fixedly mounted to a wall or floor, and could therefore be moved for use at any place as necessary.

5 Claims, 6 Drawing Sheets

STAND-UP BEDSIDE HOISTING APPARATUS

BACKGROUND OF THE INVENTION

The present invention relates to a stand-up bedside hoisting apparatus including legs that enable the whole hoisting apparatus to stably stand up without the need of being fixedly mounted to a wall or floor, so that the apparatus may be conveniently relocated when a sickbed is moved to a different place as needed.

A bedside hoisting apparatus is conventionally designed to fixedly mount to a wall or floor adjacent to one side of a sickbed to assist moving of an ill abed patient or an aged person between the sickbed and a wheelchair or other medical equipment either in a hospital or at home. Thus, a bedside hoisting apparatus not only enables a bedside attendant to take care and move the patient or the aged in an energy-saving manner, but also protects the patient or the aged against injury or impact in the course of moving.

All the currently available bedside hoisting apparatus are wall-mount type. That is, these bedside hoisting apparatus are fixedly mounted to a wall or floor and have the advantage of compact volume to occupy only a small room. However, the hoisting apparatus are immovable once they are mounted to the wall or floor. To protect the patient and the aged from impact and falling, the bedside hoisting apparatus must have strong structure and be firmly attached to the wall or the floor to safely support the weight of the patient or the aged. In many developed countries, such as the United States, only a certified professional is allowed to install the wall-mount type bedside hoisting apparatus.

When the sickbed is to be moved to a different place, the bedside hoisting apparatus has to be dismounted from the wall or the floor and re-mounted on a wall or floor in the vicinity of the relocated sickbed by the certified professional. It is time-consuming to do so and would increase the user's burden.

SUMMARY OF THE INVENTION

It is therefore a primary object of the present invention to provide a stand-up bedside hoisting apparatus that could stand independently and stably without the need of mounting to a wall or floor. A consumer could purchase the apparatus and install the same by himself. The apparatus could be easily relocated whenever the sickbed is moved to a different place, and therefore provides higher elasticity in use.

To achieve the above and other objects, the stand-up bedside hoisting apparatus of the present invention mainly includes a base; three legs fixedly connected an inner ends to the base to stably support the entire hoisting apparatus; a pivoted-arm mechanism including a lower rotary shaft that can be rotated relative to the base within a safe angular range, and an upper suspension arm that can be turned up and down relative to the rotary shaft; and a hanger pivotally connected to a front end of the suspension arm for holding a hoisting carriage to carry and move a patient.

In the stand-up bedside hoisting apparatus of the present invention, one of the three legs is forward extended from a front side of the base, while the other two are extended from two lateral sides of the base in two opposite directions, so that the three legs are arranged in the shape of a letter T.

Moreover, the base of the hoisting apparatus is provided with an upright hollow column, into which a lower end of the rotary shaft of the pivoted-arm mechanism is inserted for the rotary shaft to rotate leftward and rightward relative to the upright column. The upright column is provided at a top rear edge with a stopper, and the rotary shaft is provided on an outer surface with a radially extended pin adapted to abut on two ends of the stopper on the upright column, so that the rotary shaft is rotatable within in a range limited by the stopper and the pin to avoid collision of the hoisted patient with a wall adjacent to the sickbed.

The hanger is pivotally connected to the suspension arm via a pivot joint, so that the hanger is 360-degree rotatable relative to the pivoted-arm mechanism and turnable to and fro to change a distance between the hanger and the front end of the suspension arm, enabling easy orientation of the hoisted patient to a desired position before completely lowering the patient to the sickbed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
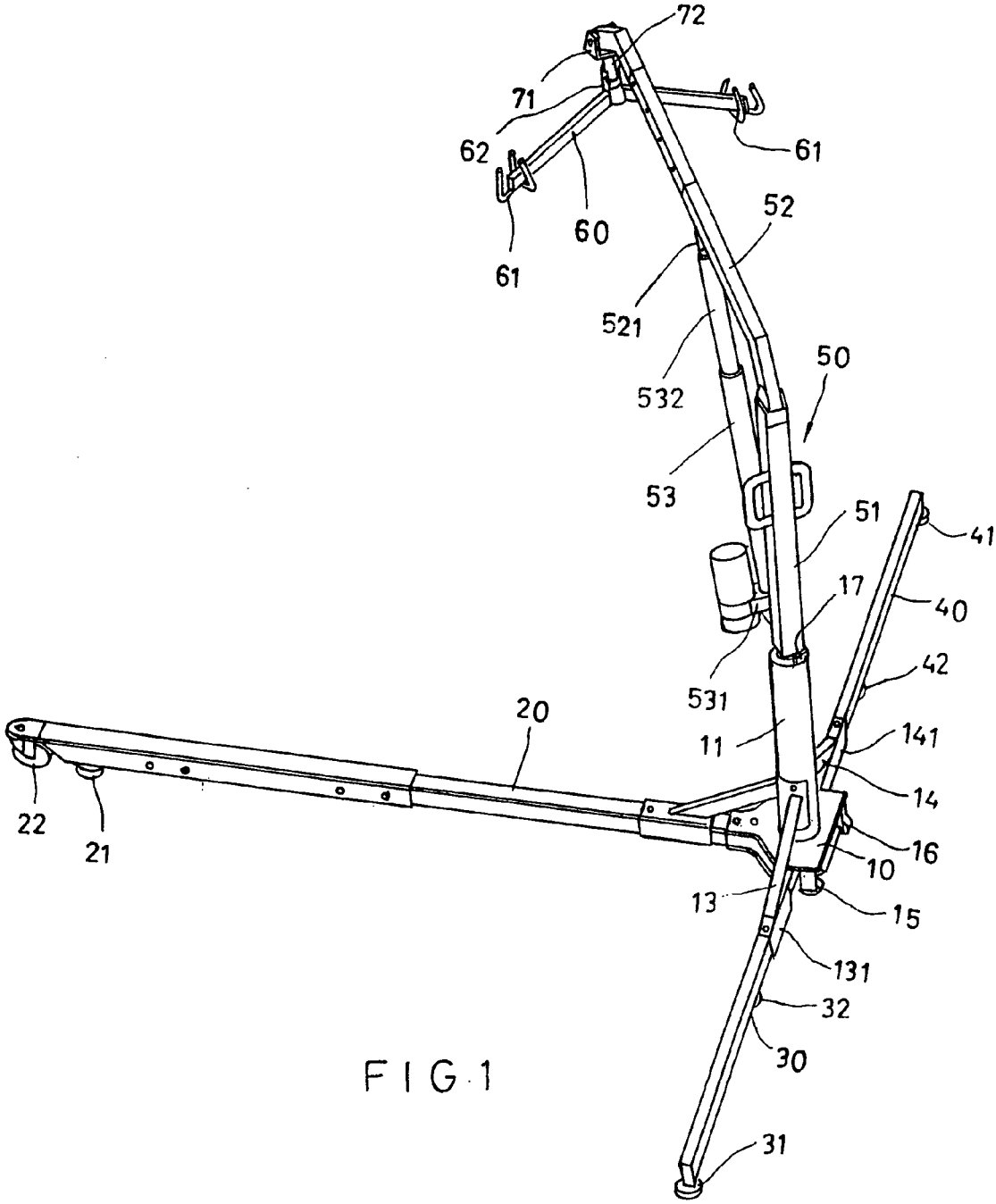
FIG. 1 is an assembled rear perspective view of a stand-up bedside hoisting apparatus according to the present invention.
Figure 3:
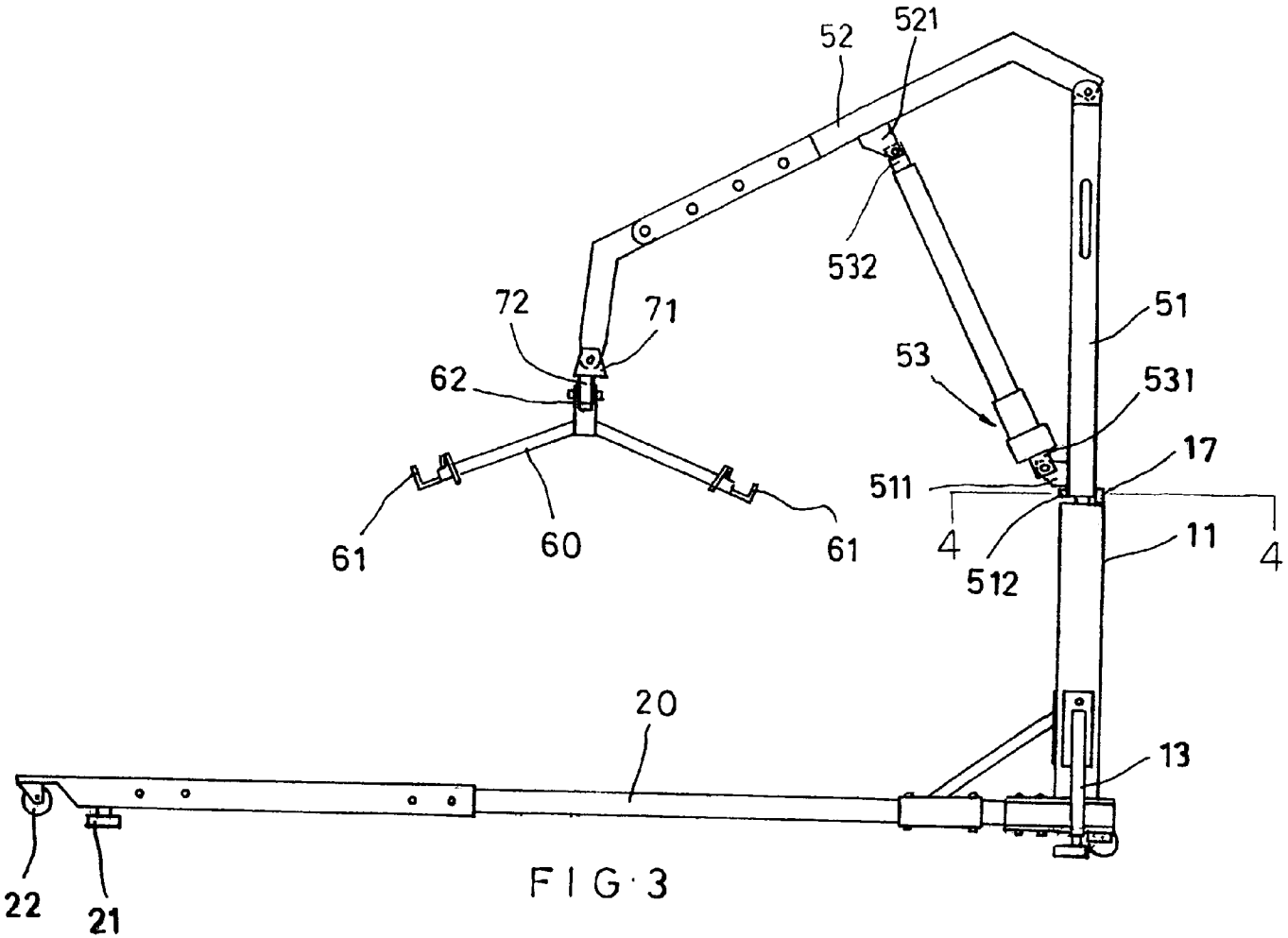
FIG. 3 is a side view of the hoisting apparatus of FIG. 1.

Please refer to FIGS. 1 and 3 that are rear perspective and side views, respectively, of a stand-up bedside hoisting apparatus according to the present invention. The apparatus mainly includes a base 10, a front leg 20, two lateral legs 30 and 40, a pivoted-arm mechanism 50, and a hanger 60.

Figure 2:
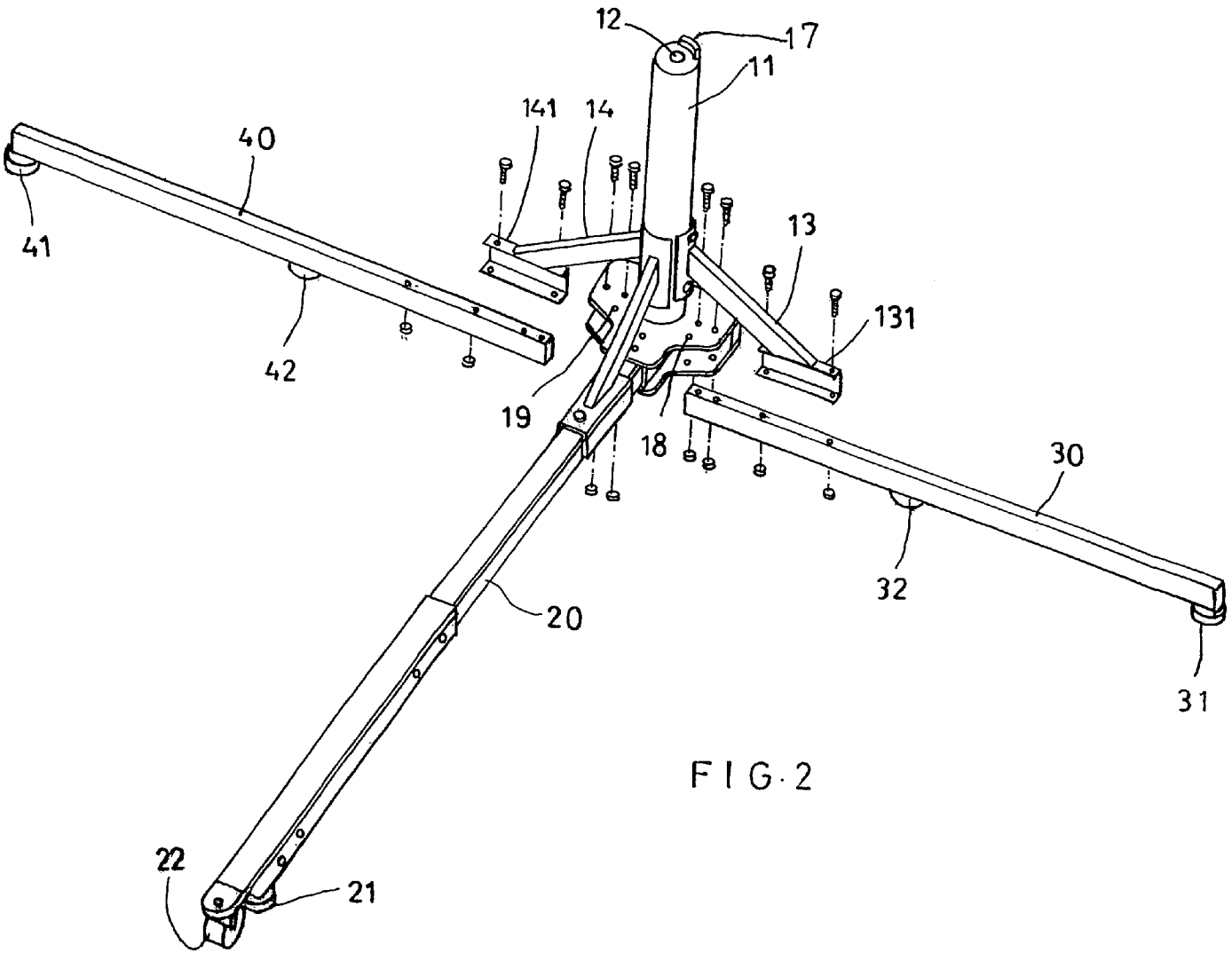
FIG. 2 is a partially exploded front perspective view showing connection of three legs to the base of the hoisting apparatus of FIG. 1.

Please refer to FIG. 2 that is an exploded front perspective view of the base 10 and the legs 20, 30 and 40. The base 10 is provided with an upright column 11 that defines a central shaft hole 12; two braces 13, 14 downward and outward extended from two lateral sides of the upright column 11 and having two forward-opened brackets 131, 141, respectively, fixedly connected to lower outer ends thereof; and two wheels 15, 16 spaced below the base 10 (see FIG. 1) to facilitate convenient moving of the base 10 and provide supporting force to the base 10 when the hoisting apparatus is in use and sinks the base 10.

The front and the two lateral legs 20, 30, 40 are connected at their respective inner ends to the base 10 with fastening means. The front leg 20 extends forward from the base 10 and the two lateral legs 30, 40 extend sideward in two opposite directions from the base 10, so that the three legs 20, 30 and 40 are arranged in the shape of a letter T. All the three legs 20, 30 and 40 are provided at their respective lower outer ends with height-adjustable supports 21, 31 and 41 to provide sufficient supporting force for the entire hoisting apparatus to stand stably.

The purpose for the three legs 20, 30 and 40 to extend in the form of a letter T is to adapt the entire hoisting apparatus to most places at where the hoisting apparatus is employed to hoist a patient. That is, it is usually to locate the two lateral legs 30, 40 alongside a wall and the front leg 20 alongside a bedside. The column 11 is provided at a top rear edge with an axial projection 17 to serve as a stopper, the function of which will be described latter.

Figure 7:
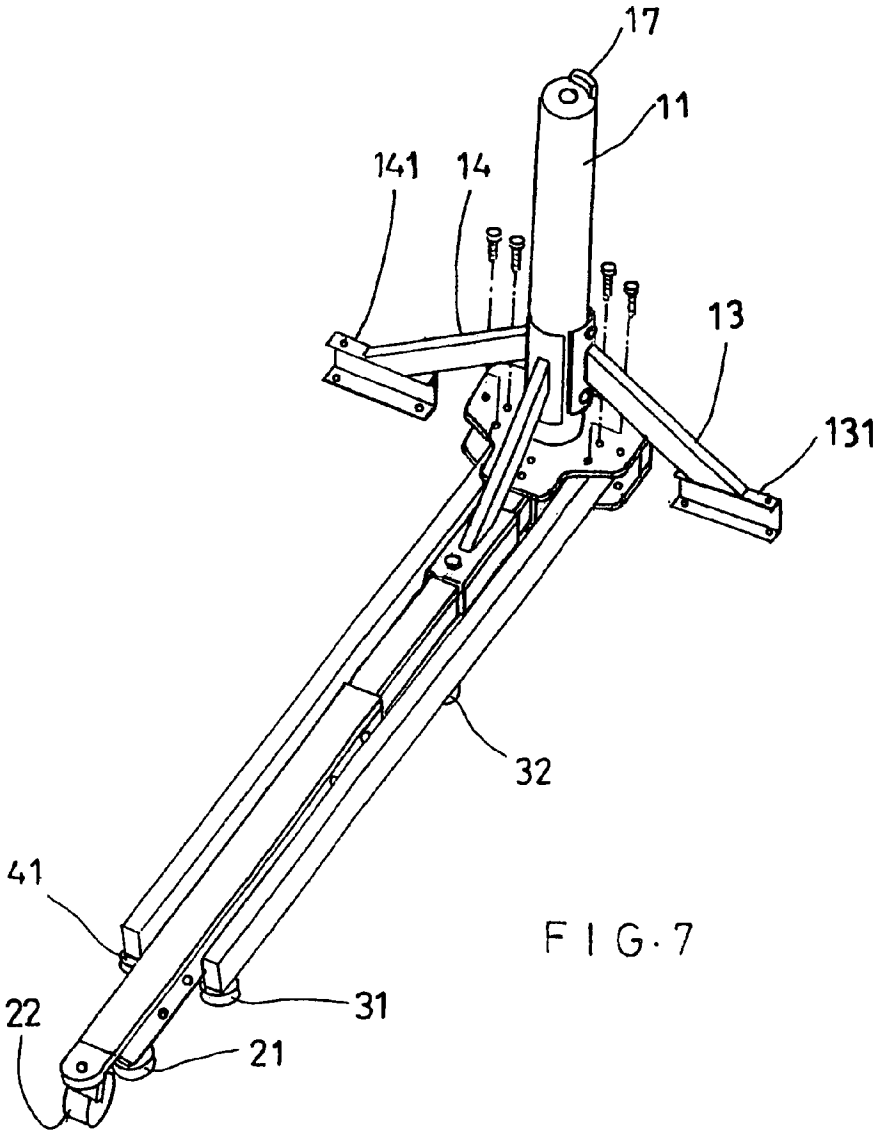
FIG. 7 is a top front perspective view showing the legs of the hoisting apparatus of the present invention are moved into a folded position for storage.

The two lateral legs 30, 40 are extended through the forward-opened brackets 131, 141 and detachably connected thereto with fastening means to ensure firm connection of the lateral legs 30, 40 to the base 10. The lateral legs 30, 40 may be separated from the forward-opened brackets 131, 141 and turned into a folded position to locate at two sides of the front leg 20 to occupy only very small space, as shown in FIG. 7. To hold the two lateral legs 30, 40 to the folded position, the base 10 is correspondingly provided with through holes 18, 19, through which fastening means may be extended to lock the lateral legs 30, 40 to two sides of the front leg 20.

The front leg 20 is a two-section telescopic leg. A front section thereof may be telescopically received on a rear section to shorten an overall length of the front leg 20, as shown in FIG. 7. A wheel 22 is provided below an outmost end of the front leg 20. When the front section of the front leg 20 is telescoped into the rear section and the two lateral legs 30 and 40 are turned into the folded position, the wheel 22 is in contact with the ground to facilitate moving of the entire hoisting apparatus. The two lateral legs 30,40 may also be provided at predetermined positions with wheels 32, 42, respectively, to enable turning of the legs 30, 40 to the folded position in a smooth and energy-saving manner.

Please refer back to FIGS. 1 and 3. The pivoted-arm mechanism 50 is mounted on the base 10 and includes a rotary shaft 51, a suspension arm 52, and an extension mechanism 53. The rotary shaft 51 forms a lower part of the pivoted-arm mechanism 50 and has a lower end rotatably inserted into the shaft hole 12 of the upright column on the base 10. The suspension arm 52 is pivotally connected at a rear end to an upper end of the rotary shaft 51 so as to turn up and down relative to the rotary shaft 51. The extension mechanism 53 includes a main body 531 pivotally connected to connecting lugs 511 projected from a lower part of the rotary shaft 51 (see FIG. 3), and an extension tube 532 extendably received in the main body 531 and having an outer end pivotally connected to connecting lugs 521 projected from the suspension arm 52. When the extension tube 532 is driven to extend from or retract into the main body 531 of the extension mechanism 53, the suspension arm 52 is caused to turn up or down relative to the rotary shaft 51 and the base 10.

Figure 4:
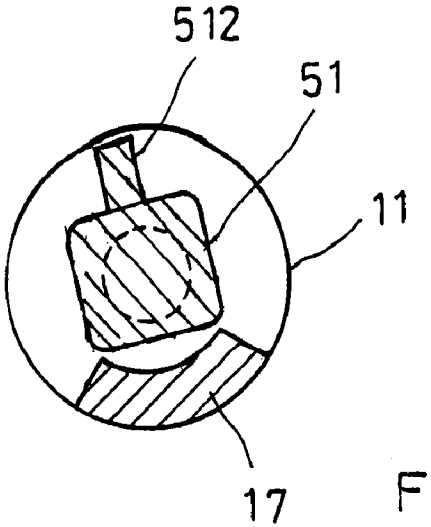
FIG. 4 is a fragmentary and enlarged cross section taken on line 4—4 of FIG. 3.
Figure 6:
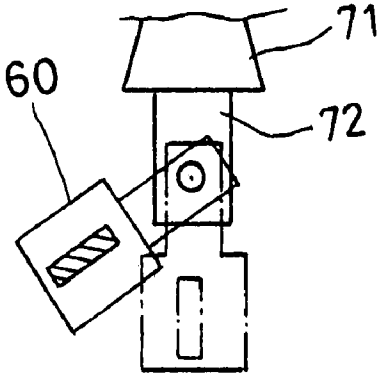
FIG. 6 is a fragmentary side view of FIG. 5 showing movement of the hanger relative to the pivot joint.
Figure 5:
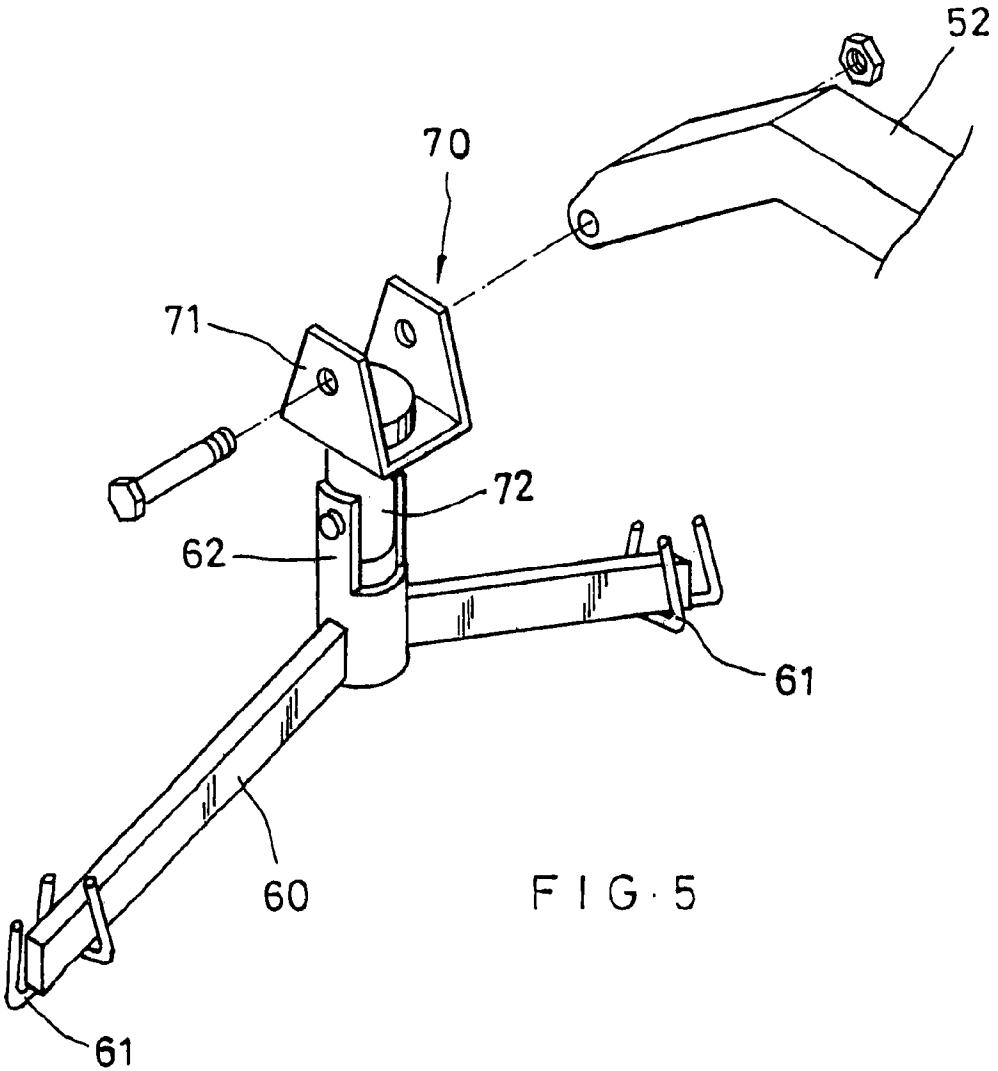
FIG. 5 shows the hanger and the suspension arm of the hoisting apparatus of the present invention are connected to one another via a pivot joint.

As can be seen from FIGS. 2, 3 and 4, the rotary shaft 51 is provided at an outer surface with a radially extended pin 512 that would be in contact with two lateral ends of the stopper 17 provided on the top rear edge of the upright column 11 to limit a rotating angle of the rotary shaft 51. That is, the stopper 17 and the pin 512 together define a safe range for the rotary shaft 51 to turn leftward and rightward, so that a patient hoisted on the hoisting apparatus of the present invention would not collide with the wall alongside which the two lateral legs 30, 40 of the hoisting apparatus are positioned.

Please refer to FIGS. 1, 3, 5 and 6. The hanger 60 is a conventional device having claws 61 provided at outer ends of two arms thereof for hanging a hoisting carriage (not shown) therefrom, and two opposite lugs 62 provided on a top of the hanger 60. The hanger 60 is pivotally connected to a front end of the suspension arm 52 via a pivot joint 70.

The pivot joint 70 includes a U-shaped bracket 71 pivotally connected at two upper ends to the front end of the suspension arm 52, and a pivot bolt 72 perpendicularly extended through a bottom of the bracket 71 and rotatable relative to the bracket 71 by 360 degrees. The two lugs 62 of the hanger 60 are pivotally connected to the pivot bolt 72, so that the hanger 60 is turnable to and fro relative to the suspension arm 52 and 360-degree rotatable relative to the bracket 71. This arrangement enables lowering of the hoisted patient toward the sickbed in desired position and direction. When the hoisted patient is lowered with his or her hips in contact with the sickbed, the hanger 60 may be turned relative to the pivot bolt 72 of the pivot joint 70 to change a distance between a lower end of the hanger 60 and the front end of the suspension arm 52, and turned relative to the bracket 71 to orient the hoisted patient to the desired position. In this manner, it would not need to move the patient any further once the patient has been completely lowered onto the sickbed. The patient is therefore well protected from undesired pull or push while being moved between the sickbed and a wheelchair or other medical equipment.

The stand-up bedside hoisting apparatus of the present invention is easy to erect and transport, allowing consumers to erect the hoisting apparatus by themselves. The bedside hoisting apparatus of the present invention therefore provides more elasticity and convenience in use as compared with the conventional ones that must be fixedly mounted to the wall or floor.

What is claimed is:

1. A stand-up bedside hoisting apparatus, comprising a base being provided at a top with an upright column that defines a central shaft hole;

three legs, a first of which being a front leg fixedly connected at an inner end to said base to extend forward from said base, and the other two of which being two lateral legs pivotally connected at respective inner ends to two lateral sides of said base to extend sideward from said base in two opposite directions, so that said two lateral legs and said front leg are arranged in the shape of a letter T; and said three legs being provided at their respective lower outer ends with a height-adjustable support for said three legs to stably support said hoisting apparatus;

a pivoted-arm mechanism mounted on said base and including a rotary shaft, a suspension arm, and an extension mechanism; said rotary shaft having a lower end rotatably mounted in said shaft hole defined on said upright column of said base, and an upper end pivotally connected to a rear end of said suspension arm, so that said suspension arm is up and down turnable relative to said rotary shaft; and said extension mechanism including a main body pivotally connected at a lower end to lugs provided on said rotary shaft, and an extension tube extendably received in said main body and having an upper end pivotally connected to lugs provided on said suspension arm; and a hanger pivotally connected to a front end of said suspension arm of said pivoted-arm mechanism via a pivot joint.

2. The stand-up bedside hoisting apparatus as claimed in claim 1, wherein said upright column of said base includes two lateral braces downward and outward extended from two lateral sides of said upright column, said two braces being provided at their respective lower ends with two forward-opened U-shaped brackets, such that said two lateral legs are extended through and detachably fixed to said two forward-opened U-shaped brackets.

3. The stand-up bedside hoisting apparatus as claimed in claim 1, wherein said upright column of said base is provided at a top rear edge with an axial stopper having a predetermined width, and said rotary shaft of said pivoted-arm mechanism being provided on an outer surface with a radially extended pin; said pin being adapted to contact with two lateral ends of said stopper on said upright column to limit a rotating angle of said rotary shaft relative to said base.

4. The stand-up bedside hoisting apparatus as claimed in claim 1, wherein said base is provided at a bottom with two wheels.

5. The stand-up bedside hoisting apparatus as claimed in claim 1, wherein said pivot joint connecting said hanger to said suspension arm includes an upward-opened U-shaped bracket that is pivotally connected at upper ends to said front end of said suspension arm, and a pivot bolt perpendicularly and 360-degree rotatably extended through a bottom of said U-shaped bracket to pivotally connect to an upper end of said hanger.

* * * * *